US005950880A

United States Patent [19]

Garcia

[11] Patent Number: 5,950,880

[45] Date of Patent: Sep. 14, 1999

[54] SET OF COMPONENTS FOR ASSEMBLY AS A DISPENSING PACKAGE OF THE NON-VENTED TYPE HAVING A TAKE-UP PISTON

[75] Inventor: Firmin Garcia, Evreux, France

[73] Assignee: Valois S.A., Le Neubourg, France

[21] Appl. No.: 08/838,003

[22] Filed: Apr. 14, 1997

[51] Int. Cl.[6] ..... B67D 5/42

[52] U.S. Cl. ..... 222/321.7; 222/321.9; 222/256

[58] Field of Search ..... 222/321.1, 321.7, 222/321.9, 256

[56] References Cited

U.S. PATENT DOCUMENTS

| | | | |
|---|---|---|---|
| 4,809,878 | 3/1989 | Rainey | 222/321.9 |
| 5,004,123 | 4/1991 | Stoody . | |
| 5,102,018 | 4/1992 | Desazars de Montgailhard et al. | 222/321.9 |
| 5,271,534 | 12/1993 | Fillmore et al. . | |
| 5,562,219 | 10/1996 | De Pous et al. | 222/321.9 X |
| 5,642,908 | 7/1997 | Mascitelli | 222/321.9 X |
| 5,687,878 | 11/1997 | Smith et al. | 222/321.9 X |
| 5,692,649 | 12/1997 | Schwab | 222/321.9 X |

FOREIGN PATENT DOCUMENTS

| | | |
|---|---|---|
| 354 137 A1 | 2/1990 | European Pat. Off. . |
| 381 627 A1 | 8/1990 | European Pat. Off. . |
| 410 857 A1 | 1/1991 | European Pat. Off. . |
| 486 355 A1 | 5/1992 | European Pat. Off. . |
| 499 766 A1 | 8/1992 | European Pat. Off. . |
| 505 611 A2 | 9/1992 | European Pat. Off. . |
| 521 278 A1 | 1/1993 | European Pat. Off. . |
| 548 840 A2 | 6/1993 | European Pat. Off. . |
| 585 908 A2 | 3/1994 | European Pat. Off. . |
| 696 479 A1 | 2/1996 | European Pat. Off. . |
| 2 668 756 | 5/1992 | France . |
| 2 669 306 | 5/1992 | France . |
| 2685 285 | 6/1993 | France . |
| 2 710 036 | 3/1995 | France . |
| 2 718 372 | 10/1995 | France . |
| 2 059 383 | 4/1981 | United Kingdom . |
| WO 93/22220 | 11/1993 | WIPO . |
| WO 93/24392 | 12/1993 | WIPO . |

OTHER PUBLICATIONS

"Valois Perfumery" brochure dated "Aug. 1996.", p. 1–24.

"Valois Cosmetics" brochure date "Mar. 1993.", p. 1–24.

*Primary Examiner*—Kenneth Bomberg

*Attorney, Agent, or Firm*—Rockey, Milnamow & Katz, Ltd.

[57] ABSTRACT

A set of components is provided for assembly as a non-vented dispensing package for a fluid product. A hollow body with a take-up piston is provided for holding the fluid product. The body is attached to a holding member to which is mounted a finger-operable pump that is in communication with the interior of the hollow body.

9 Claims, 3 Drawing Sheets

SET OF COMPONENTS FOR ASSEMBLY AS A DISPENSING PACKAGE OF THE NON-VENTED TYPE HAVING A TAKE-UP PISTON

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a dispensing package for containing and dispensing a fluid product. More particularly, the invention relates to an improved set of components which can be assembled to form the package of the type that includes a finger-operable pump mounted over a hollow body in which the fluid product is contained in a non-vented region between the pump and a take-up piston.

BACKGROUND OF THE INVENTION AND TECHNICAL PROBLEMS POSED BY THE PRIOR ART

Manufacturers of various fluid products have found that in some cases it is desirable to provide such products to a user in a package that readily accommodates dispensing of the product and yet protects the product from oxidation or other external contaminants during storage. It may also be desirable to provide such a product in a package that can be operated in any orientation to dispense the product.

A type of package that has been employed to accommodate these requirements includes a generally tubular container or hollow body filled with the product and attached to a finger-operable pump for dispensing the fluid product from the hollow body. The pump has an actuator projecting from one end of the hollow body where the pump can be operated by the user pressing down on the pump actuator.

Inside the hollow body there is a take-up piston. The piston moves toward the pump under the influence of atmospheric pressure as the product is dispensed. This prevents unwanted voids from developing in the fluid product which could interfere with pumping the product, especially highly viscous products.

Various designs for such take-up piston packages are known. While such designs may function generally satisfactorily, it would be desirable to provide an improved design for a package that could be more readily manufactured.

In particular, it would be advantageous to provide an improved design which could incorporate a conventional finger-operable pump. Such an improved design should also preferably facilitate the filling of the hollow body with the fluid product, attachment of the pump, and assembly of the other package components with a minimum number of manufacturing steps or special manufacturing operations.

In addition, it would be beneficial to provide such an improved dispensing package design that does not require an excessive number of components, that can be assembled relatively rapidly at low cost and without requiring excessively small manufacturing tolerances and assembly tolerances.

It would also be advantageous if various portions of the package components could be relatively easily modified so as to provide various external configurations which may be desired for utilitarian or aesthetic purposes.

The present invention provides an improved set of components for assembly as a dispensing package which can accommodate designs having the above-discussed benefits and features.

SUMMARY OF THE INVENTION

In accordance with the present invention, a dispensing package can be readily assembled from a set of components which accommodate the filling of the package with a fluid product. The product filling is preferably effected under vacuum. In the preferred embodiment, this is facilitated by arranging the components in two subassemblies. A first subassembly can be filled with the fluid product, preferably under vacuum, and then the second subassembly can be mounted to the first subassembly to form a complete package.

Two or three components can be connected together to form the first subassembly. One of the components is a hollow, tubular member having an open bottom end and an open top end defining a discharge opening or passage. The hollow, tubular member may be characterized as defining a hollow body for containing the fluid product.

The second component of the first subassembly is a take-up piston sealingly disposed within the hollow body for moving toward the discharge end of the hollow body in response to the discharge of any amount of fluid product from the body. This action decreases the internal volume of the body by an amount equal to the volume of the amount of the fluid product which is discharged. The piston moves toward the discharge end of the hollow body during dispensing of the fluid owing to atmospheric pressure acting on the exterior surface of the piston.

An optional third component of the first subassembly is a closure member at the bottom end of the hollow body, below the take-up piston. The closure member has one or more vent holes to permit ambient atmosphere to act on the exterior surface of the take-up piston.

The second subassembly is assembled from two main components and preferably includes one or two additional components. The first component is a holding member which can be attached to the hollow body of the first subassembly, preferably by a snap-fit engagement. The holding member defines (1) an opening which can be located adjacent the open discharge end of the hollow body, and (2) a flange around the inside of the opening.

A second component of the second subassembly is a finger-operable pump which can be mounted in the holding member. When properly mounted, the fingeroperable pump extends within the open discharge end of the hollow body and within the opening of the holding member. The pump has an inlet for communicating with the interior of the hollow body, and the pump has an outlet for projecting beyond the holding member opening.

The second subassembly preferably includes a third component which is a separate gasket designed to insure a leak-tight seal between the pump and the discharge end of the hollow body over which the pump is mounted.

Further, the second subassembly may optionally include a fourth component in the form of a cover or cap which is adapted to be mounted over the upwardly projecting, outlet end of the pump and which is intended to be removed by the user when the user desires to dispense fluid product from the package.

Typically, the first subassembly is assembled by inserting the piston into the bottom end of the tubular, hollow body and then securing the bottom closure member to the bottom of the hollow body. Thereafter, the hollow body can be filled with fluid product in a vacuum-assisted filling process through the open discharge end of the hollow body.

Subsequently, the second subassembly pump and holding member can be mounted on the first subassembly so that the holding member is attached to the hollow body. This is also accomplished under vacuum, and preferably the above-described gasket is disposed around the pump or open discharge end of the hollow body prior to mounting the pump and holding member in place on the hollow body.

If the package is to also include a cap, then the cap may be initially attached to the holding member over the pump prior to mounting the second subassembly components together on the first subassembly.

According to one aspect of the present invention, means are provided for attaching the holding member to the pump in a way that facilitates manufacture of the components and facilitates high-speed assembly. In particular, the pump defines a radially outwardly extending flange and at least one radially outwardly extending rib spaced above the pump flange. The rib and flange together define a recess between them for receiving a flange which extends radially inwardly on the holding member. Either the pump or the holding member, or both, are resiliently deflectable, at least in the region of the pump rib and/or holding member flange. This accommodates relative movement of the pump rib and holding member flange past each other so that the holding member flange is received in a mating relationship in the recess between the pump flange and rib so as to establish a snap-fit engagement.

According to another aspect of the present invention, means are provided for attaching the holding member to the hollow body around the open discharge end of the hollow body, and such means facilitate manufacture of the components and facilitate subsequent assembly of the components in a relatively high-speed process. Specifically, the holding member includes at least one inwardly extending bead. The hollow body includes at least one radially outwardly open groove. Either the holding member or the body, or both, are resiliently deflectable, at least in the region of the bead and/or groove, so as to accommodate relative movement of the bead and groove into a mating relationship establishing a snap-fit engagement.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the components of this invention are described in an upright operating position, and terms such as upper, lower, horizontal, etc., are used with reference to this position. It will be understood, however, that the components of this invention may be manufactured, stored, transported, used, and sold in an orientation other than the position described.

Figures illustrating the components show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
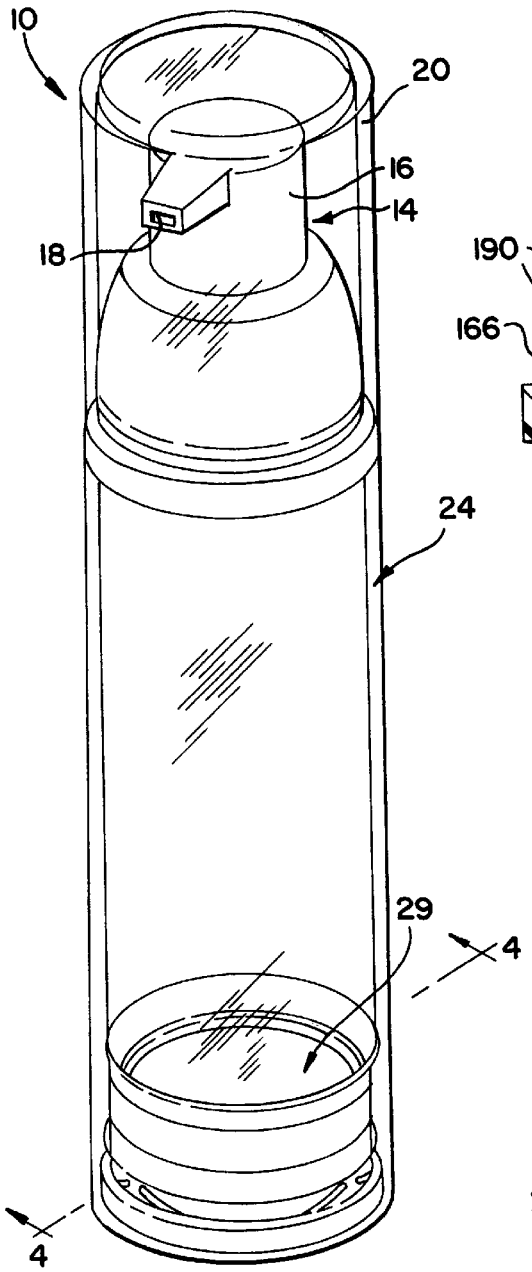
FIG. 1 is a perspective view of a preferred embodiment of a completed dispensing package assembled from the set of components according to one form of the present invention.

A dispensing package 10 is designated generally by the reference numeral 10 in FIG. 1. The package 10 is adapted to dispense a fluid product, typically a liquid, cream, paste, or the like. Such products may include personal care products such as shampoos, lotions, and the like. Such products may also include household cleaners, industrial preparations, and other substances. The package 10 illustrated in FIG. 1 may be regarded, for purposes of illustration, as containing a generally transparent, liquid, product.

Figure 3:
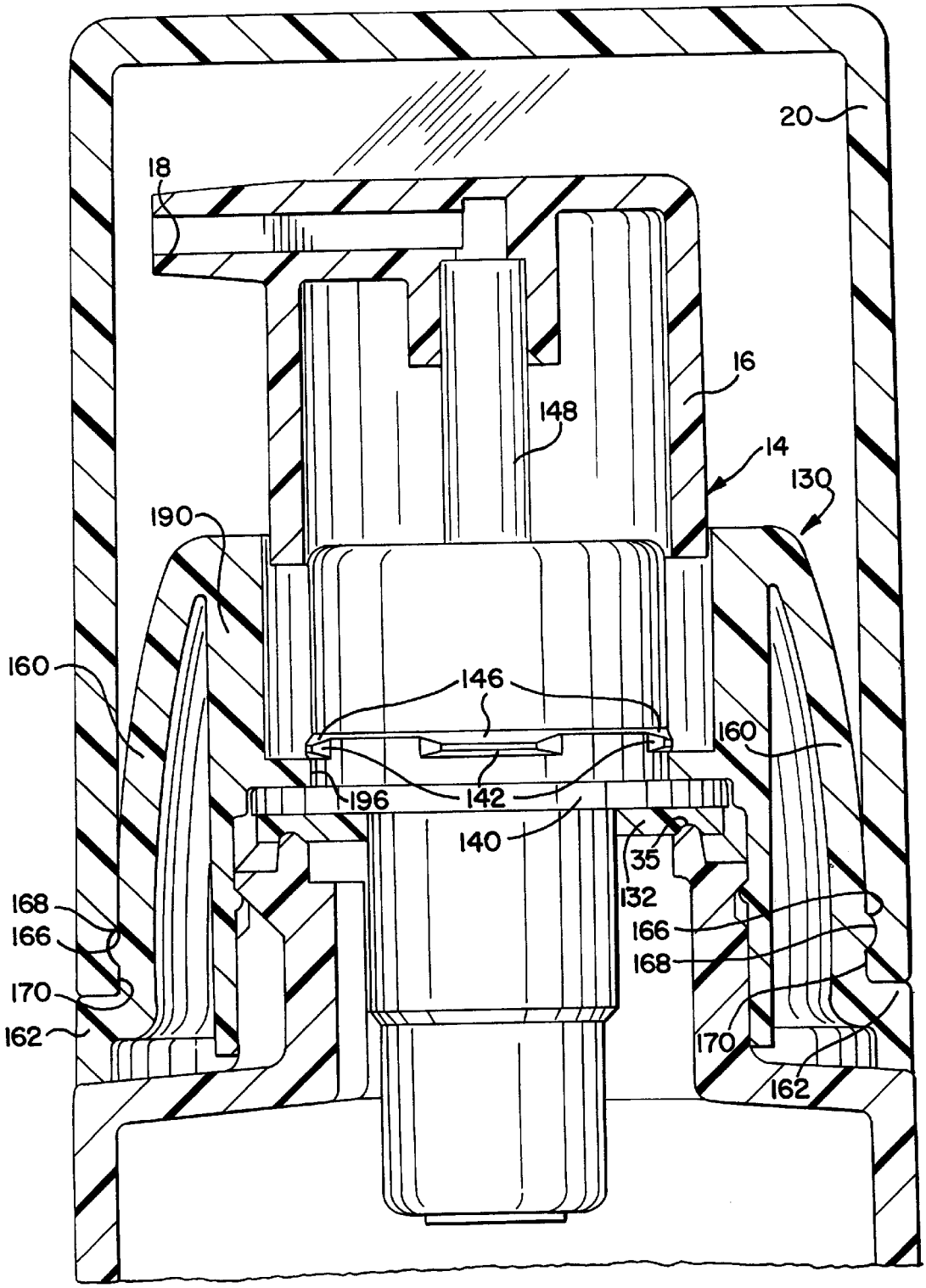
FIG. 3 is a fragmentary, enlarged, cross-sectional view of the package shown in FIG. 1.

The package 10 includes a container assembly which includes a projecting, finger-operable pump 14. The pump 14 may be a suitable, conventional, non-venting type of pump having a pump chamber in which is disposed a pressurizing piston that can be actuated by pressing down on an external actuator button or plunger 16 so as to dispense a quantity of the fluid product from a dispensing orifice 18. An optional cover or cap 20 may be releasably mounted over the pump 14 (FIGS. 1 and 3). The cap 20 is shown as molded from a substantially transparent material. However, in many applications, the cap 20 is preferably made from an opaque material.

The package 10 includes a tubular structure or hollow body 24 for containing the fluid product. The hollow body 24 is illustrated in the figures as being made from a substantially transparent material, such as a transparent thermoplastic material. However, in many applications, the body is preferably made from an opaque material.

The body 24 most typically would have a circular, transverse cross section. However, the hollow body 24 may have an oval shape, or some other shape, wherein the internal, transverse cross section is substantially uniform along most of its length.

Figure 4:
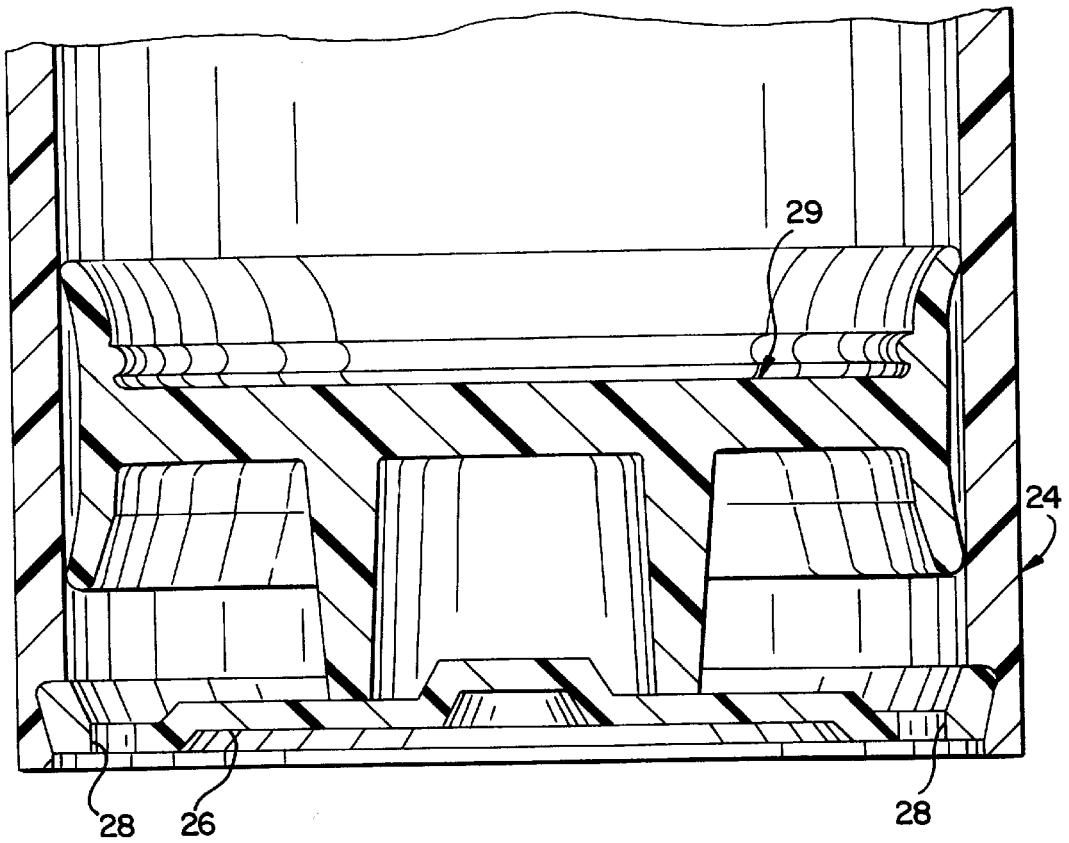
FIG. 4 is a fragmentary, enlarged, cross-sectional view of the bottom portion of the package.

As shown in FIG. 4, the bottom of the hollow body has an open end which is normally closed by a base closure member 26 which defines one or more apertures 28. The closure member 26 has a transverse cross section corresponding generally to the transverse cross section of the hollow body 24. The closure member 26 is typically secured to the bottom of the hollow member 24 by means of a snap-fit engagement, by adhesive, or by other suitable means. However, prior to securement of the closure member 26 to the hollow body 24, a piston 29 is inserted into the lower, open end of the hollow body 24. The piston sealingly engages the interior surface of the hollow body 24 and is adapted to slidingly move upwardly in the hollow body 24. The piston 29 can thus function as a take-up piston for moving toward the pump 14 at the upper, discharge end of the hollow body 24.

The take-up piston 29 moves toward the pump 14 at the discharge end of the body 24 in response to the discharge of any amount of fluid product from the body 24 so as to decrease the internal volume of the body 24 by an amount equal to the volume of the amount of fluid product which is discharged. The movement of the piston 29 is effected by the atmospheric pressure of the ambient air which acts against the exterior, bottom surfaces of the piston 29. It will be appreciated that the vent passages 28 in the bottom end closure member 26 insure that the ambient atmosphere will be in continuous contact with the exterior of the piston 29 regardless of how far the piston 29 travels up in the hollow body 24.

The particular design and configuration of the take-up piston 29, and the particular material or materials from which the piston 29 may be fabricated, are matters of design choice consistent with the configuration and material used for the hollow body 24 and consistent with the fluid product contained within the hollow body 24. Any suitable conventional or special piston design may be employed. The details of the design per se of such a piston 29 form no part of the present invention.

The upper, discharge end of the body 24 defines a reduced-diameter neck 32. The upper end of the neck defines an external, peripheral shoulder 34. The side of the neck defines an annular, outwardly open groove 36. The distal end of the neck 36 defines an upwardly projecting, annular rim 35 at the inside diameter of the shoulder 34. In the preferred embodiment wherein the hollow body 24 is injection molded from a thermoplastic material, two recesses 37 in the shoulder 34 are the injection molding points.

Also, in a preferred form of the invention, the neck 32 has an exterior, vertical notch or slot 38 and an interior, vertical rib 40. The exterior notch or slot 38 can be used to position the hollow body 24 to a desired rotational orientation (relative to the vertical, longitudinal axis) during a printing process wherein text and/or graphics are applied to the exterior of the body 24 by suitable conventional or special means, the details of which form no part of the present invention.

Generally, an external tool engages the notch 38 to effect the desired rotational positioning of the body 24 during the printing process. An alternative, interior tool may be employed for rotationally positioning the hollow body 24, and such an internal tool would engage the interior rib 40. The detailed design and operation of an external tool or internal tool for effecting the rotational position of the body form no part of the present invention.

The hollow body 24, along with the take-up piston 29 and base closure member 26, may be characterized as the lower subassembly or first subassembly. However, in some applications, the base closure member 26 may be omitted altogether from the first, or lower, subassembly. In any event, after the lower subassembly has been assembled, it can be filled with the fluid product, and then the additional package components, comprising an upper subassembly or second subassembly as described below, are installed on the filled, first subassembly.

Figure 2:
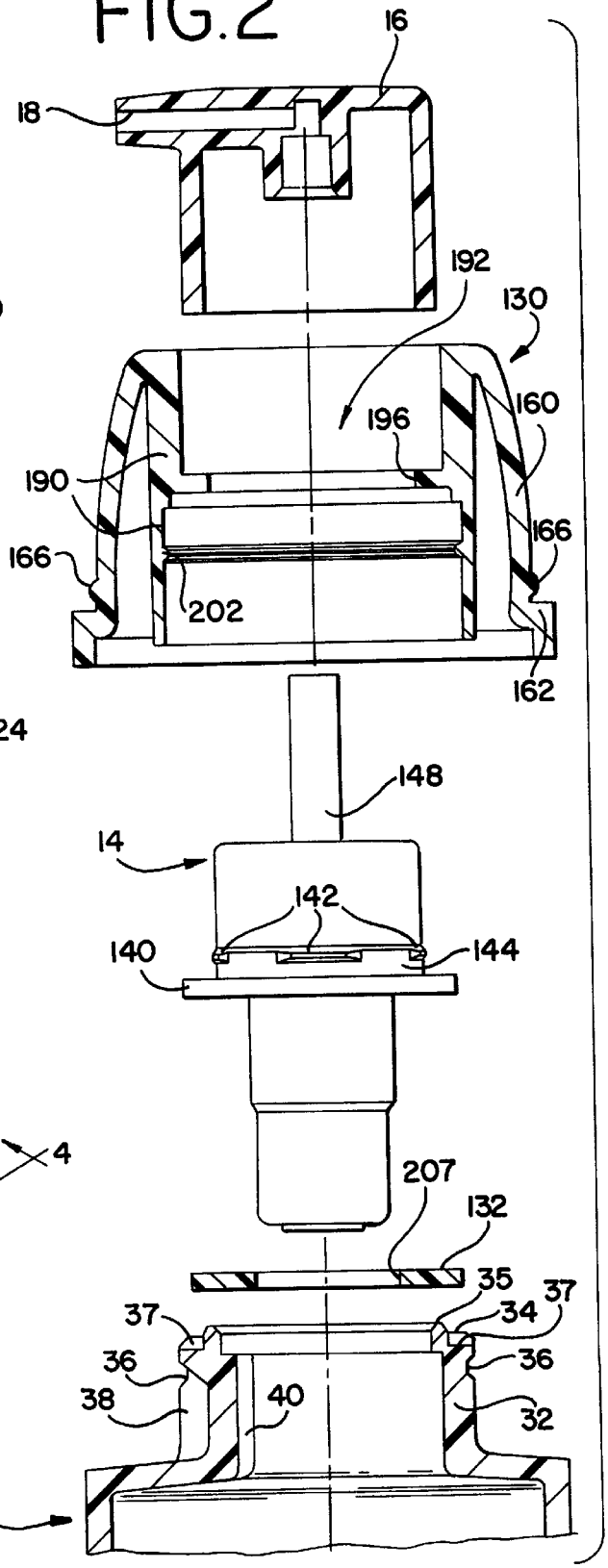
FIG. 2 is a fragmentary, enlarged, exploded, cross-sectional view of some of the components of the package.

The second subassembly or upper subassembly is designed for being mounted to the lower subassembly and comprises at least two components. One of the components of the upper or second subassembly is the pump 14, and another component is a holding member 130 (FIG. 2). The actuator button 16 may be regarded as part of the pump 14. Additional components are also preferably included in the upper subassembly, and such additional components may include a gasket 132 (FIG. 2) and the cap or cover 20 (FIGS. 1 and 3).

The exterior of the pump 14 is designed to be mounted within the holding member 130, along with the gasket 132 if the gasket is employed. Specifically, the pump 14 has a radially extending mounting flange 140 (FIGS. 2 and 3). The pump 14 also defines one or more bosses or ribs 142. Preferably, there are a plurality of circumferentially spaced, outwardly extending bosses or ribs 142. The ribs 142 are spaced above the pump flange 140 to define an annular recess 144 between the flange 140 and the ribs 142. Preferably, as shown in the enlarged FIG. 3, the upper surface of each rib 142 is chamfered or angled downwardly to define a camming surface 146.

The internal pumping mechanism of the pump 14 may be of any appropriate conventional or special non-venting design. Typically, a conventional, non-venting pump, such as the pump 14 illustrated in the figures, has an interior chamber (not visible) which has a check valve at the lower end and in which is disposed a pressurizing piston (not visible). The pressurizing piston is arranged to cooperate with a hollow stem 148 which extends out through the top of the body of the pump 14 and which is received within the pump actuator button 16. The stem 148 and the piston within the pump body can move downwardly together in the pump chamber, but the hollow stem 148 can also move for some distance separately relative to the piston so as to establish communication through the hollow stem 148 between the pump chamber and the actuator button 16. One or more springs (not visible in the figures) act against the piston and/or stem 148 inside the pump body to bias the piston, stem 148, and actuator button 16 upwardly to an elevated rest position when finger pressure is released. When the actuator button 16 is pressed, product is dispensed from the pump 14.

One conventional non-venting pump that may be employed is the pump designated VP36/200 and sold by Valois S.A., 50 Avenue de L'Europe, 78160 Marly le roi, France. Such a pump is described in the brochure entitled "Valois Cosmetics" as published by Valois S.A. and bearing a printing date of "March 1993." The description of the VP36/200 pump in the brochure is incorporated herein by reference thereto to the extent that the description is not inconsistent with the present disclosures. It will be appreciated, however, that the detailed design and operation of the internal components of such a pump, which may be employed for the pump 14 described herein, form no part of the present invention.

The holding member 130 includes a peripheral, convex shroud 160 providing a pleasing, external configuration. The bottom of the shroud 160 has a laterally projecting flange or shoulder 162. At four locations around the shroud 160 above the flange 162, there are small, outwardly projecting protuberances 166 (FIGS. 2 and 3). Each of the protuberances 166 is adapted to establish a snap-fit engagement in an annular groove 168 above a radially inwardly extending protuberance or bead 170 at the bottom of the cap or cover 20 (FIG. 3). The cap or cover 20 and/or the lower portion of the holding member shroud 160 are resiliently deflectable so as to accommodate relative movement between the cap 20 and shroud 160 as the cap 20 is installed on the package. The cap 20 and/or shroud 160 deflect sufficiently so that the cap bead 170 can be located below, and adjacent, the protuberances 166 of the holding member shroud 160. This confronting relationship establishes the snap-fit engagement.

Projecting downwardly from the shroud 160 in the holding member 130 is an annular sleeve 190 (FIGS. 2 and 3). The sleeve 190 defines an opening, bore, or passage 192 (FIG. 2) for accommodating the annular neck 32 of the hollow body 24 and for accommodating the upwardly projecting portion of the pump 14 (FIG. 3).

An annular flange 196 extends radially inwardly from the holding member annular sleeve 190 for engaging the upper surface of the pump flange 140 (FIG. 3). The sleeve 190 also includes an inwardly extending bead 202 for being received in the annular groove 36 defined in the hollow body neck 32.

Typically, the pump 14 is initially disposed in the holding member 130, along with the gasket 132 if employed. To this end, the installation is accomplished with the pump actuator 16 initially removed from the pump. Relative movement between the pump 14 and the holding member 130 is effected so as to introduce the pump into the holding member 130 from the bottom end of the holding member. The pump camming surfaces 146 (FIG. 3) on the pump ribs 142 engage the lower, inner edge of the holding member flange 196. When sufficiently large, opposed, axial forces are applied to the holding member 130 and pump 14, there is temporary deflection or deformation of one or both of the components in the radial direction so that the pump ribs 142 can be moved past the holding member flange 196. Relative movement is effected to locate the ribs 142 on the upper side of the holding member flange 196 so that the lower side of the flange 196 is adjacent the upper surface of the pump flange 140. Either the holding member 130 or the pump 14, or both, is resiliently deflectable, at least in the region of the flange 196 and/or ribs 142, so as to accommodate relative movement of the ribs 142 and flange 196 into a mating relationship which establishes a snap-fit engagement. When properly mounted within the holding member 130, the pump flange 140 is received in the groove 144 (FIG. 2) which is defined between the pump ribs 142 and the pump flange 140. After the pump 14 is mounted in the holding member 130, the actuator 16 can be installed on the top of the pump 14.

The gasket 132, if employed, may be slipped up the bottom end of the pump 14. To this end, the gasket defines a hole 207 (FIG. 2) which may have a diameter slightly less than the diameter of the pump body just below the pump flange 140. The gasket material is typically sufficiently elastic to accommodate a small amount of stretching so that the gasket 132 can be retained on the pump body just below the pump flange 140 by means of a friction fit.

If desired, the cap 20 can also be initially mounted with a snap-fit engagement to the holding member 130 over the pump 14. This upper subassembly is then ready to be mounted to the hollow body 24 of the lower subassembly after the lower subassembly is filled with the fluid product.

Prior to mounting the two subassemblies together, the lower subassembly is filled with a fluid product. This can be conveniently done pursuant to a conventional or special filling process which is typically performed under vacuum. Preferably, vacuum (i.e., a reduced pressure) is created by a suitable vacuum system around the body 24. The air below the piston 29 within the body 24 is evacuated through the vent holes 28 in the base closure member 26 of the body 24. Then the fluid product is discharged from a filling machine into the hollow body 24 through the opening in the body neck 32. Next, with vacuum still enveloping the components, the upper subassembly (comprising the pump 14, holding member 130, gasket 132 if employed, and cap 20 if employed) is moved into position on the lower subassembly hollow body 24 so as to establish the snap-fit engagement between the hollow body 24 and holding member 130.

Either the holding member 130 or the hollow body 24, or both, are resiliently deflectable, at least in the region of the holding member bead 202 and/or body neck groove 36, so as to accommodate relative movement of the bead 202 and groove 36 into a mating relationship establishing a snap-fit engagement.

The particular process and detailed operation of filling the body 24 and mounting the upper subassembly on the lower subassembly form no part of the present invention.

When the two subassemblies are properly mounted together as shown in FIG. 3, the pump flange 140 urges the gasket 132 into sealing engagement with the upper end of the body neck rim 35. However, depending upon the materials employed in the construction of the pump 14 and/or body rim 35 or neck 32, the gasket 132 may either be omitted altogether or be included as a unitary part of either the pump flange 140 or the upper end of the body neck 32.

The set of components provided according to the present invention can be readily manufactured from thermoplastic materials at relatively low cost. For example, the tubular hollow body 24, holding member 130, and cap 20 may each be conveniently molded as a unitary structure form polypropylene. Thus, packages made from the set of components may be regarded as disposable packages or throw-away packages.

The set of components can be readily assembled to provide a package which can be easily used. Except for the removable cap 20, the components are not readily disassembled, and the completed package protects the fluid product from oxidation or other external contaminants.

It will be readily apparent from the foregoing detailed description of the invention and from the illustrations thereof that numerous variations and modifications may be effected without departing from the true spirit and scope of the novel concepts or principles of this invention.

What is claimed is:

1. A set of components for assembly as a dispensing package for containing and dispensing a fluid product, said set comprising:

a hollow body for containing said fluid product and having an open discharge end;

a take-up piston sealingly disposed within said hollow body for moving toward said discharge end in response to the discharge of any amount of said fluid product from said body so as to decrease the internal volume of said body holding said fluid product by an amount equal to the volume of the amount of said fluid product which is discharged;

a holding member which can be attached to said body, said holding member defining an opening which can be located adjacent said body open end, said holding member including an exterior shroud and an annular sleeve defining said opening, said exterior shroud and said annular sleeve each having an upper portion connected together, said exterior shroud and said annular sleeve being substantially axially coextensive, said exterior shroud having a lower portion defining a shoulder which can function as a seat for limiting downward displacement of said cap relative to said exterior shroud;

a cap for mounting to said holding member;

a finger-operable pump which can be mounted to said holding member within said holding member opening, said pump having an inlet for communicating with the interior of said body and having an outlet for projecting beyond said holding member opening; and said holding member defining a radially inwardly extending flange, said pump defining a radially outwardly extending flange and at least one radially outwardly extending rib spaced above said pump flange to define a recess between said pump flange and said pump rib for receiving said holding member flange in mating relationship, and at least one of said pump and said holding member being resiliently deflectable to accommodate relative movement of said pump rib and holding member flange past each other so that said holding member flange is received in said recess in mating relationship between said pump flange and rib to establish a snap-fit engagement.

2. The set of components in accordance with claim 1 in which each said pump rib defines an angled camming surface.

3. The set of components in accordance with claim 1 in which said pump ribs are circumferentially spaced around the exterior of said pump.

4. The set of components in accordance with claim 1 in which said holding member flange extends inwardly from said sleeve.

5. The set of components in accordance with claim 1 in which said hollow body includes a neck having an upwardly projecting rim; and said set of components includes a gasket for being compressed against said rim by said pump flange.

6. A set of components for assembly as a dispensing package for containing and dispensing a fluid product, said set comprising:

a hollow body for containing said fluid product and having an open discharge end;

a take-up piston sealingly disposed within said hollow body for moving toward said discharge end in response to the discharge of any amount of said fluid product from said body so as to decrease the internal volume of said body holding said fluid product by an amount equal to the volume of the amount of said fluid product which is discharged;

a holding member which can be attached to said body, said holding member defining an opening which can be located adjacent said body open end, said holding member including an exterior shroud and an annular sleeve defining said opening, said exterior shroud and said annular sleeve each having an upper portion connected together, said exterior shroud and said annular sleeve being substantially axially coextensive, said exterior shroud having a lower portion defining a shoulder which can function as a seat for limiting downward displacement of said cap relative to said exterior shroud;

a cap for mounting to said holding member;

a finger-operable pump which can be mounted to said holding member within said holding member opening, said pump having an inlet for communicating with the interior of said body and having an outlet for projecting beyond said holding member opening;

said holding member defining a radially inwardly extending bead, said body defining a radially outwardly open groove for receiving said bead in mating relationship, and at least one of said body and said holding member being resiliently deflectable to accommodate relative movement of said bead and groove into said mating relationship establishing a snap-fit engagement; and said holding member defining a radially inwardly extending flange said pump defining a radially outwardly extending flange and at least one radially outwardly extending rib spaced above said pump flange to define a recess between said pump flange and said pump rib for receiving said holding member flange in mating relationship, and at least one of said pump and said holding member being resiliently deflectable to accommodate relative movement of said pump rib and holding member flange past each other so that said holding member flange is received in said recess in mating relationship between said pump flange and rib to establish a snap-fit engagement.

7. The set of components in accordance with claim 6 in which said holding member bead is defined in the inside of said sleeve.

8. The set of components in accordance with claim 6 in which said holding member flange is defined on the inside of said sleeve.

9. The set of components in accordance with claim 6 in which said holding member bead is spaced below said holding member flange.

* * * * *